US005540159A

United States Patent [19]

Anderson

[11] Patent Number: 5,540,159

[45] Date of Patent: Jul. 30, 1996

[54] TELEVISION STAND

[76] Inventor: Robert F. Anderson, 5300 13th St., Menominee, Mich. 49858

[21] Appl. No.: 446,292

[22] Filed: May 22, 1995

[51] Int. Cl.[6] ..... A47B 13/02

[52] U.S. Cl. ..... 108/150; 108/153

[58] Field of Search ..... 108/150, 49, 42, 108/44, 27, 110, 153, 144, 106; 248/159; 297/217.6

[56] References Cited

U.S. PATENT DOCUMENTS

| | | | |
|---|---|---|---|
| 1,659,572 | 2/1928 | Klemm | 297/217.6 X |
| 1,765,643 | 6/1930 | Allibone et al. | 108/23 |
| 1,862,237 | 6/1932 | Pepler . | |
| 1,884,698 | 2/1932 | Snyder | 108/32 X |
| 2,869,949 | 1/1959 | Kennedy et al. | 108/27 |
| 3,054,122 | 9/1962 | Sarkus . | |
| 3,139,189 | 6/1964 | Kolarik | 108/153 X |
| 3,538,862 | 11/1970 | Patriarca | 108/23 X |
| 4,501,512 | 2/1985 | Hiltz | 108/153 X |
| 4,724,773 | 2/1988 | Newberry et al. | 108/150 |
| 4,780,919 | 11/1988 | Harrison . | |
| 5,207,405 | 5/1993 | Cobb . | |
| 5,293,826 | 3/1994 | Perez . | |

FOREIGN PATENT DOCUMENTS

| | | | |
|---|---|---|---|
| 1231089 | 5/1971 | United Kingdom | 108/49 |

*Primary Examiner*—Jose V. Chen
*Attorney, Agent, or Firm*—C. Kenneth Bjork

[57] ABSTRACT

A stand particularly suited for supporting a television set or computer which comprises a planar top members, a connector on the bottom surface of this top member which also is a coupling attached to one end of a hollow shaft, a second coupling holding the second end of the shaft and affixed to a bracket of a configuration to provide for attachment of the stand to a bed.

13 Claims, 2 Drawing Sheets

TELEVISION STAND

BACKGROUND OF THE INVENTION

1. Field of the Invention

The present invention relates to a support stand for holding a television set and more particularly is directed to a stand for supporting a television set which is adapted for attachment to a bed unit.

2. Description of the Prior Art

There is a wide variety of entertainment centers, stands and support brackets for holding television sets. However, a need exists for a stand designed for holding smaller screen size television receivers, e.g. up to 15 inches diagonally measured picture tube, as are commonly used in bedrooms. Use of generally available cabinet or shelf type stands, or entertainment centers or wall support brackets is not always best for bedroom viewing for a variety of reasons. Often there is lack of floor space to accomodate this type of furniture. The height of the shelves or top of a stand can be too high or too low for comfortable viewing and these usually are not adjustable. Electrical receptacles may not be conveniently located and unsightly electrical cords and antenna cables many times cannot readily be hidden from view. Further, when smaller screen television sets are used with conventional stands, they may be too far away from the bed for comfortable viewing. The television support stand of the present invention overcomes such disadvantages and inconveniences and provides a number of unique features and advantages. It does not require any floor space, hides electrical power supply cords and television antenna lead-in cables, and in use is a practical distance away from the head of a bed for good viewing of smaller television screens. The stand can be positioned at varying heights or turned sideways to a position to meet individual needs and desires. Further, it is relatively inexpensive to fabricate and easy to assemble.

SUMMARY OF THE INVENTION

The support stand of the present invention comprises a planar top member, a connector on the bottom surface of said planar member which is attached to one end of a hollow shaft and a coupling which holds the other end of the shaft. These in combination provide a passage up through the coupling and shaft exiting through the planar top member. The coupling is affixed to a bracket of a configuration to provide for attachment to the corners or other locations on the sides or foot of a bed unit.

The planar member, hereinafter referred to as the top of the stand, ordinarily will be square or rectangular and sized to accommodate the base of a television set. However, it is to be understood that this member can be round, elliptical, or of other geometric configurations. The top surface of this member can be angled, i.e. tapered, upwardly from front to back such that the high end, i.e. that which is the furthest away from the viewer is about 0.5 to about 2 centimeters higher than the front edge of the top. This elevation can be fabricated to be part of the top itself or can be achieved by fastening tapered members onto the top surface of the stand top near the sides and joining there at their high end with a connecting strip. This embodiment provides a storage area under the television set for storage of electrical cord and cable. This unique feature tilts a television set slightly forward when placed on the stand, thereby reducing glare on the screen. This top contains an opening at about its midpoint of a size to pass an electrical power cord and antenna cable through the top. The top can be constructed from wood or rigid plastic for ease in manufacture.

A connector with open through passage is attached to the bottom surface of the stand top positioned such that the opening in the stand top and that of the connector mesh. The top end of a hollow shaft is fitted into the connector. One preferred embodiment of a connector is a flanged coupling, the flanged end of which is attached to the bottom surface of the stand top and the other end which is cylindrical and holds one end of a tubular hollow shaft. Conveniently, the coupling has internal threads which mate with external threads at the end of the shaft. In another embodiment of flanged coupling, the mating surface of the shaft and coupling can be smooth-walled to provide a sliding fit. In this embodiment, the shaft and coupling do not have to be round in cross-section but can be of other geometrical configurations, as long as they can be slid one into the other. In the smooth walled embodiments, a set screw, thumb screw or other locking means can be used to further secure these elements together. However, this has not been found to be necessary. In yet another connector embodiment, this member can be of flexible jointed construction providing both vertical, tilting movement and side-to-side linear movement. In this embodiment, the use of a tapered top surface for the top of the stand is not necessary.

The height of the stand can be predetermined in one embodiment by using two segments for the shaft which are joined by a coupling. A plurality of shaft segments of different lengths can be provided to enable the assembly of a stand of predetermined height as needed or desired by the television viewer. The shaft segments readily can be fitted together by threaded or slip fit coupling/shaft assembly as disclosed hereinbefore. In this embodiment for ease of assembly, disassembly, and interchangeability, the shaft segments and all couplings will have mating thread portions.

Another shaft embodiment is a telescoping tube. In this type of shaft, the telescopic segments can be held in a predetermined position by a lock nut, set screw, thumb screw or other locking means known to one skilled in the art. To achieve a strength-to-weight ratio capable of supporting the weight of a television set, the shaft preferably is constructed of metal, such as steel or non-ferrous metals, e.g. copper, aluminum, magnesium, brass and the like, or alloys thereof. Heavy duty, high strength, weight supporting polymer also can be used in constructing the shaft and couplings.

The lower end of the shaft fits into a mating coupling affixed to a bracket which fastens onto the bottom, sides or corner of a box spring, bed frame or platform. The bottom of the shaft and coupling of the bracket are joined by the same means disclosed hereinbefore.

The bottom bracket of the stand which supports the shaft in vertical position can be made in a variety of shapes. It is only essential that the bracket have a coupling affixed thereto which holds the bottom of the shaft. In one preferred embodiment, the bracket comprises a two-arm unit forming a right-angle having a coupling firmly attached to its exterior sidewall at the junction of the arms. This type of bracket is designed to be attached to a corner of a box spring or bed frame. For increased strength and support, this embodiment of bracket can be formed from a right-angle stamping, forging or extruded strip. This embodiment thus has a bottom and sidewall which provides securing both to adjacent sides and the bottom of a box spring or bed frame.

An alternative to the two modifications disclosed directly above has the coupling fixed to the arms of the bracket on its inner wall at the junction of the arms. This bracket is particularly suited for use with a platform bed assembly as disclosed in U.S. Pat. No. 5,099,529.

Yet another embodiment of a bracket encompassed by the scope of the present invention is fabricated in the form of a plate or sheet with at least one or two upturned sides which has a coupling affixed thereto. This embodiment can be attached to the bottom of a box spring, for example, being positioned along a side, the foot end or a corner. Generally, the bracket is fitted with spaced apart small holes or openings along the arms, upturned edge, or plate for securing the bracket with screws to a box spring or wood bed frame, or with bolts and nuts to a steel bed frame.

The coupling of the bracket can have a fully or partially open or fully closed bottom with a threaded shaft/coupling connection, the same open type coupling as used to connect the shaft segment of predetermined lengths can be used. Ordinarily with a slip fit arrangement, the bottom of the coupling can be partially closed to stop the shaft from sliding through while still providing passage for an electrical cord and antenna cable. If a closed bottom i.e. cup-like coupling is used with the bracket, an opening can be provided in the sidewall of the shaft above the coupling to provide passage for such cords and cables.

If desired, for added safety and security, mating openings can be provided in the coupling and shaft and a cottor pin or bolt and nut assembly passed through these from side to side to hold the shaft in a fixed, secure position. Again, as disclosed hereinbefore, a set screw, thumb screw and the like can be used to secure the shaft in fixed position in the coupling of the bracket.

To achieve the proper strength, generally the bracket will be fabricated from steel, although other metals or high strength polymers can be used.

BRIEF DESCRIPTION OF THE DRAWINGS

Further aspects and advantages of the invention will become apparent from the following descriptions taken together with the accompanying drawings in which.

DETAILED DESCRIPTION OF THE DRAWINGS

Figure 1:
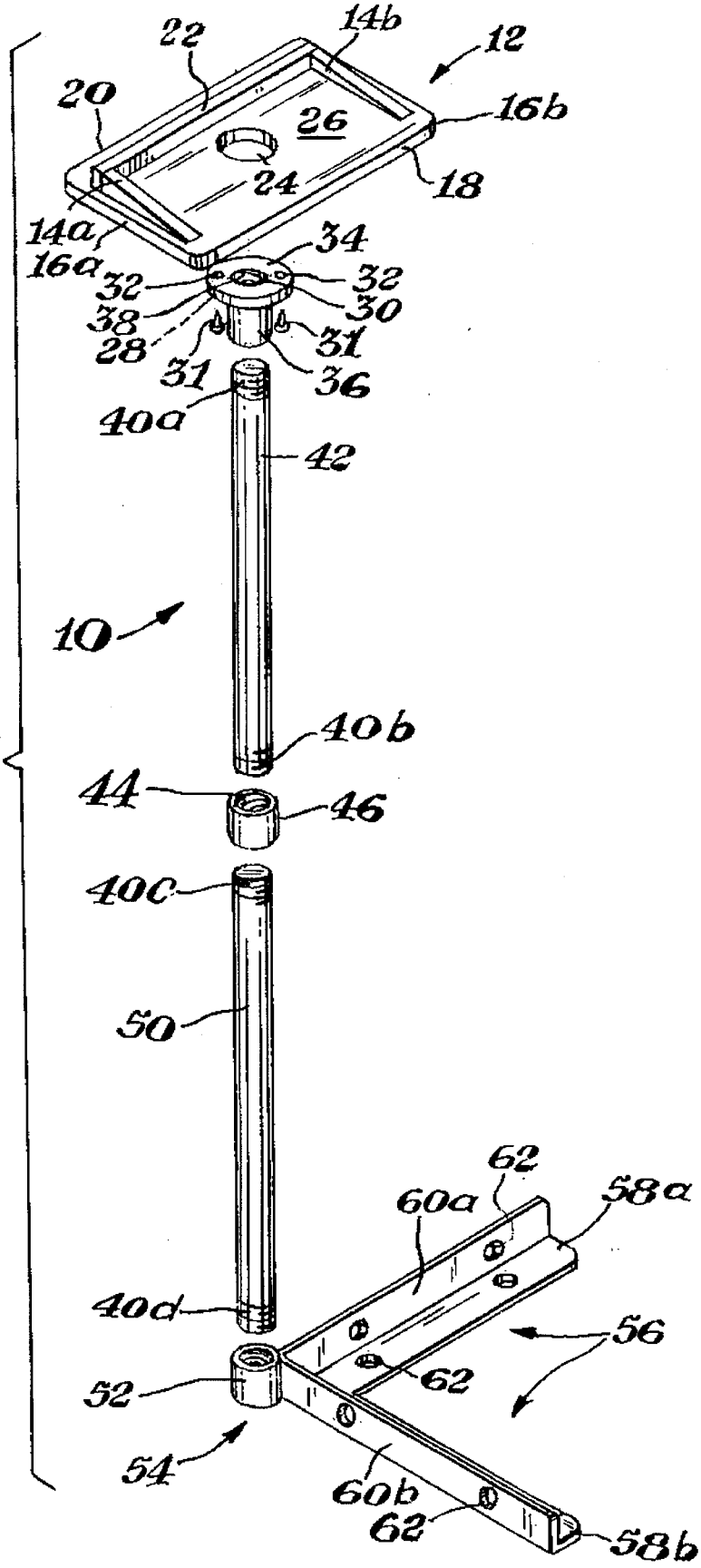
FIG. 1 an exploded perspective view of a preferred embodiment of the television stand of the present invention.

Reference is made first to FIG. 1 showing a preferred embodiment of a stand for holding a television set in accordance with the present invention. The stand generally indicated as 10 comprises a planar top 12 substantially rectangular in shape. It has rounded corners for safety. Two wedged shaped arms 14*a*–14*b* are fastened to the top surface of stand top 12 adjacent and parallel to its side edges 16*a*–16*b*. The wedged arms 14*a*–14*b* taper upwardly from the top near the front edge 18 of the top 12 toward the back side 20. The arms 14*a*–14*b* are joined at their high ends by a cross-arm 22 of the same height as the high ends of arms 14*a*–14*b*. The height of the cross-arm 22 and high ends of wedge shaped supports 14*a*–14*b* generally range from about 0.5 cm. (about 2/10 inch) to about 2 cm (about 1 inch) although this height is not critical. In practice, for optimum glare reduction, a height of about 1 inch has been found to be quite satisfactory. The assembly of wedges 14*a*–14*b* and connecting strip 22 can be glued, nailed, screwed or otherwise fastened to top 12.

The top 12 has an opening 24 at about its center. This opening 24 is of a size to accommodate an electric power cord, such as an extension cord, and antenna cable passed up through the top 12 from the bottom and out through the top surface 26.

The tapered arms 14*a*–14*b* and crossarm 22 assembly not only permits a television set to tilt slightly forward when supported by the stand but also provides for storage of excess cord and/or cable in the resulting space between the bottom of the T.V. set and top surface 26 of the stand top. 12.

A flat-head flanged coupling 28 is fastened to the bottom surface of the top 12 being positioned such that its threaded through passage, i.e. opening, 30 mates with the passage 24 in the top 12. Conveniently, the coupling 28 is fastened to the top 12 by screws 31 through a plurality of small openings 32 in the flat head 34. The outwardly projecting coupling portion 36 has interior threads 38 which mate with threads 40*a* on one end of a hollow tubular shaft segment 42. The other end of shaft segment 42 also has threads 40*b* mating with threads 44 of a tubular coupling 46. A second hollow shaft segment 50 with threaded ends 40*c* and 40*d* has one end 40*c* screwed into coupling 46 and the threaded portion 40*d* screwed into a threaded open-ended coupling 52 secured to a bracket 54.

Bracket 54 is a right-angled two arm unit having coupling 52 welded, for example, to the outer vertical wall of the bracket at the apex of the 90-degree angle, i.e. the outside corner of the bracket 54. The arms 56 of bracket 54 form a base fabricated into a horizontal bottom 58*a*–58*b* and vertical sidewall 60 i.e. bent at a right angle. Bracket 54 contains spaced apart openings 62 for securing the stand 10 by screws to the outside corner of a box spring or by bolt and nut assemblies to a conventional box spring supporting metal bed frame. The angled base 58 *a–b* - sidewall 60 *a–b* design give opportunity for securing the stand 10 both to the wall and bottom of the box spring or bed frame.

Figure 2:
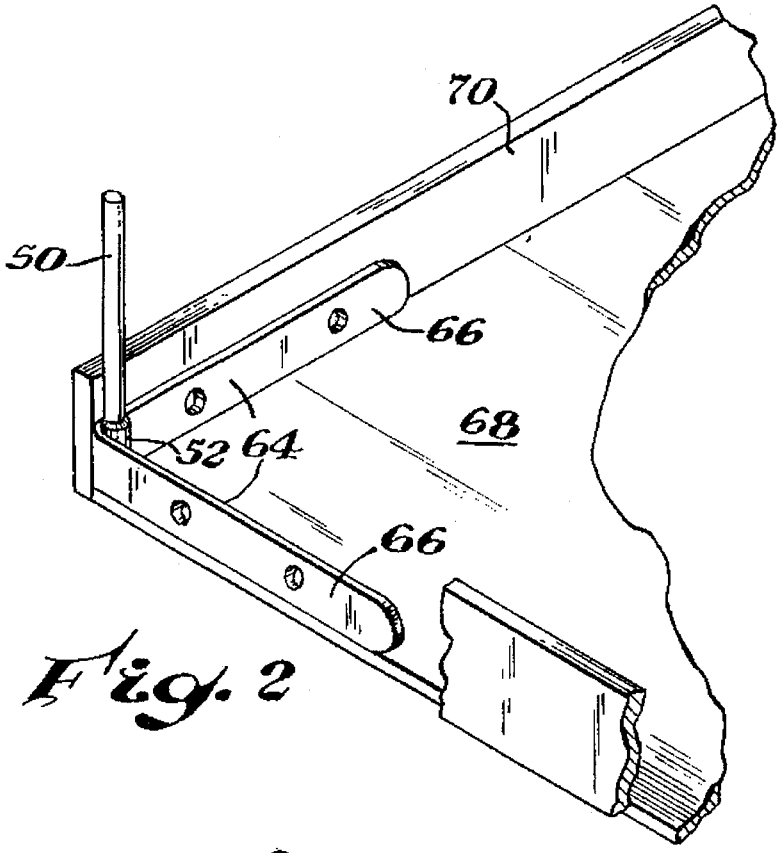
FIG. 2 is a fragmentary perspective view of another embodiment of bracket particularly designed for attachment to the inside wall of a bed platform.

The bracket 64 of FIG. 2 is of the same general two-armed configuration as described for bracket 54 but differs in that in use coupling 52 is affixed to the inner wall of arms 66 at their junction. Further, in this design, the arms 66 have no base element as the bracket 64 rests on the upper surface of a platform 68 and the arms are secured to the inside wall of the edge or sidewall 70 of a bed frame. This type of bracket is particularly suited for use with a waterbed platform or a bed frame as disclosed in U.S. Pat. No. 5,099,529.

Figure 3:
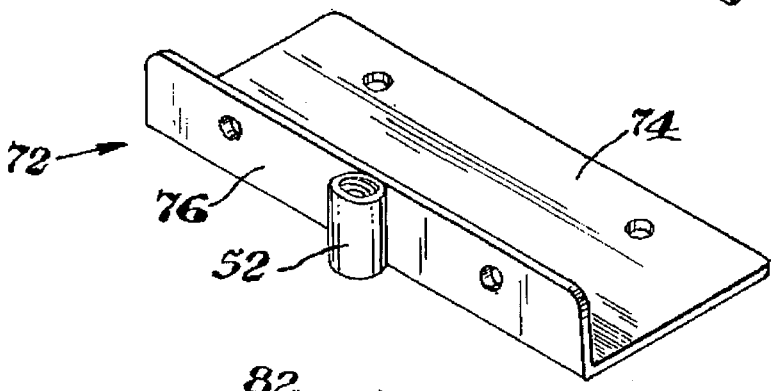
FIG. 3 is a perspective view of a plate type embodiment of a bracket of the stand which can be secured to a sidewall and bottom of a box spring or bed frame.

FIG. 3 shows another embodiment of a bracket 72. This bracket 72 is generally rectangular in shape with an elongated base 74 and short upturned sidewall 76 having coupling 52 fastened, again usually welded, in upright position on sidewall 76. It is to be understood that depending on what type of box spring or bed frame to which the stand 10 is to be attached, the coupling 52 on bracket 72 can be mounted on either the outside or inside face of sidewall 76.

Figure 4:
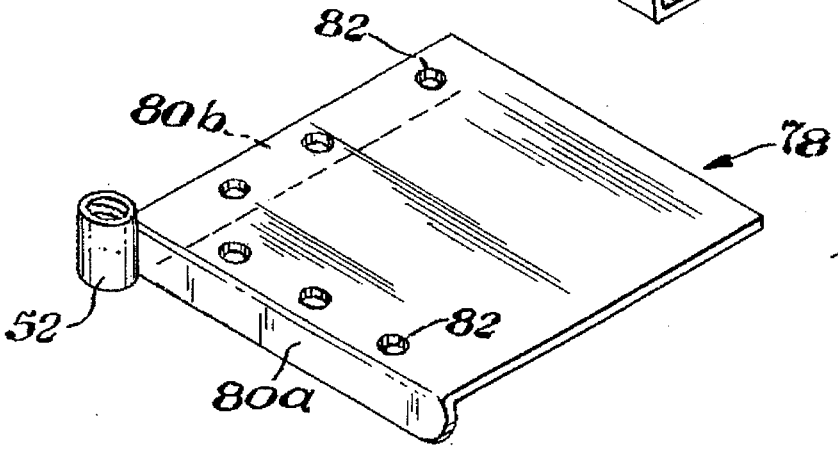
FIG. 4 is a perspective view of another plate-type bracket of the stand of the present invention which can be secured to the bottom corner of a box spring or bed frame.

Another embodiment of a bracket 78 is shown in FIG. 4. Bracket 78 is a plate-like member having two adjacent edges bent at right angles to form side walls 80*a*–80*b*. Coupling 52 is fastened to bracket 78 at the outside corner where the sidewalls 80*a*–80*b* meet. This bracket 78 does not require fixed attachment to the bed assembly because of its unique sidewalls 80*a*–80*b*. Bracket 78 can be placed between a box spring and mattress at one corner with the side walls 80*a*–80*b* facing downwards. There is sufficient support from the mattress to hold the stand in position. Here again, if desired, screws can be used to secure the bracket 78 to a box spring by means of openings 82. A variation of this bracket 78 is to have coupling 52 welded to the inside of the sidewalls 80*a*–80*b* at their junction. This bracket is used with a platform type bed frame, being placed directly on the base platform of the frame in a corner with the walls 80*a*–80*b* extending upwards. Here again, the walls can be held secure against the frame by screws, if desired.

Various modifications can be made in the present invention without departing from the spirit or scope thereof for it is understood that I intend that my invention is limited only by the scope of the appended claims.

I claim:

1. A support stand for holding a television set which comprises: a planar top member adapted to hold a television set and defining a top and bottom surface, a first connector affixed to the bottom surface of said planar member at about the midpoint of said member, said first connector comprising a flanged coupling having a coupling portion and a flanged end, the flanged end of which is attached to the bottom surface of the planar top member, the coupling portion being cylindrical and attached to one end of a mating hollow shaft, said shaft being of a predetermined length and extending from said first connector to a second connector, the second connector being a coupling mating with the other end of said shaft, said second connector being affixed to a bracket, said bracket comprising of a two-arm unit forming a right angle, said bracket providing attachment of said support stand to a bed and said planar top member, first connector, hollow shaft and second connector defining a through passage.

2. The stand as defined in claim 1 wherein the top member is rectangular in shape and the top surface which supports a television tapers upwardly from front to back and has an opening at about its midpoint.

3. The stand as defined in claim 2 wherein the top surface of the top member has a wedged arm positioned adjacent to and parallel to each of the side edges and a connecting arm joining said wedged arms at their high end, said connecting arm being of about the same height as the height of said wedged arms.

4. The stand as defined in claim 1 wherein the shaft is comprised of a plurality of segments, each of said segments having a threaded portion at each end, said threaded portions mating with threaded couplings joining said shaft segment together and the ends of said shaft mating with internal threads of the flanged coupling attached to the top member and internal threads in the coupling affixed to said bracket.

5. The stand as defined in claim 1 wherein the bracket is a plate-like member having one side edge angled to form a side wall and a connector for accommodating the shaft affixed onto said sidewall.

6. The stand as defined in claim 1 wherein the bracket is a plate-like member having two adjacent side edges angled to form sidewalls, said sidewalls defining a corner where the sidewalls meet and a connector for accommodating the shaft affixed to said bracket at the corner where the two side walls meet.

7. A stand for supporting a television set which comprises a substantially rectangularly shaped planar top member defining a top surface and a bottom surface, two wedged shaped arms fastened to the top surface of said planar top member each one adjacent and parallel to a side edge of said top member and tapering upwardly from the front of said top member and having their high ends adjacent the back of said top member, a cross-arm of the same height as the high ends of said wedged shaped arms joining said arms, said top member defining an opening at about its center, a flat head flanged coupling fastened to the bottom surface of said top member, said flanged coupling having a threaded through passage and positioned such that said through passage mates with the opening in said top member, a first bottom tubular shaft segment having threaded end portions, one of said end portions threaded into the flanged coupling, a threaded coupling, the second end of said shaft segment threaded into said threaded coupling, a second shaft segment having threaded end portions, one of said end portions fitted into said threaded coupling, a second threaded coupling, said second coupling affixed to a bracket, the second end of said second shaft segment threaded into said second coupling affixed to said bracket, said bracket fabricated to provide for attaching said stand to a bed unit.

8. The stand as defined in claim 7 wherein the bracket is a right-angle two arm unit defining a corner at the apex of the right angle and having a coupling affixed to said bracket on its exterior wall surface at the corner of said unit.

9. The stand as defined in claim 8 wherein the end of said bracket has a horizontal bottom and vertical sidewall.

10. The stand as defined in claim 8 wherein the coupling is affixed to the bracket on the interior wall surface at the corner of said unit.

11. The stand as defined in claim 7 wherein the bracket is generally rectangular in shape having an elongated base and a short sidewall, and the coupling is fastened in upright position onto the sidewall.

12. The stand as defined in claim 7 wherein the bracket is generally rectangular in shape having two adjacent edges bent at right angles forming sidewalls and defining a corner where the sidewalls meet and a coupling fastened in upright position on its external wall surface at the corner where said sidewalls meet.

13. The stand as defined in claim 7 wherein the bracket is generally rectangular in shape having two adjacent edges bent at right angles forming sidewalls and defining a corner where the sidewalls meet and a coupling fastened in upright position on its internal wall surface at the corner where said sidewalls meet.

* * * * *